US005947599A

United States Patent [19]

Funk

[11] Patent Number: 5,947,599

[45] Date of Patent: Sep. 7, 1999

[54] CONTINUOUS HIGH INTENSITY DISPERSER WITH AGITATOR DISKS

[76] Inventor: James E. Funk, 301 Maple Ave., Seneca, S.C. 29678

[21] Appl. No.: 09/200,203

[22] Filed: Nov. 25, 1998

[51] Int. Cl.[6] ..... B01F 7/26

[52] U.S. Cl. ..... 366/302; 366/317; 241/162; 241/297; 416/228

[58] Field of Search ..... 366/307, 302, 366/315–316; 241/16, 21, 144, 159, 162, 297, 298; 416/223 R, 228, 231 A

[56] References Cited

U.S. PATENT DOCUMENTS

| | | | |
|---|---|---|---|
| 1,692,617 | 11/1928 | Bowen . | |
| 2,159,856 | 5/1939 | MacLean . | |
| 3,030,083 | 4/1962 | Stiffler . | |
| 3,044,750 | 7/1962 | Schmitt, Jr. . | |
| 3,100,628 | 8/1963 | Norris, Jr. . | |
| 3,464,636 | 9/1969 | Byers . | |
| 3,630,636 | 12/1971 | Hill . | |
| 3,638,917 | 2/1972 | Osten . | |
| 4,813,787 | 3/1989 | Conn | 366/317 |
| 5,292,193 | 3/1994 | Funk | 366/307 |
| 5,409,313 | 4/1995 | Funk | 416/228 |

FOREIGN PATENT DOCUMENTS

| | | | |
|---|---|---|---|
| 1442687 | 10/1969 | Germany | 366/316 |
| 6-63372 | 3/1994 | Japan | 366/317 |
| 1567256 | 5/1990 | U.S.S.R. | 366/317 |
| 973791 | 10/1964 | United Kingdom | 366/316 |
| 2194166 | 3/1988 | United Kingdom | 366/316 |

*Primary Examiner*—Charles E. Cooley
*Attorney, Agent, or Firm*—Howard J. Greenwald

[57] ABSTRACT

An apparatus for deagglomerating powder in a mixture of liquid and powder, which contains a mixing tank, a rotatable shaft, at least two agitator disks connected to such shaft, and a vortex suppressor disposed above the topmost of such disks at a distance which is from about 30 to about 60 percent of the inside diameter of the mixing tank. The mixing tank has a height which is from about 9 inches to about 20 feet, and an inside diameter of from about 3 inches to about 3 feet; and the ratio of such height to such inside diameter is at least about 3/1. The distance between the agitator disks is from about 50 to about 200 percent of the diameter of the first agitator disk; each of such disks contains from about 4 to about 12 teeth attached around its periphery; the frontal area of each of said teeth is from about 0.02 to about 1.5 square inches; and each of such teeth is so attached that it forms an angle between the front face of the tooth and the radius of said disk of from about 5 to about 45 degrees. The agitator disks preferably contain two halves, each of which is attached to a hub connected to the shaft.

15 Claims, 5 Drawing Sheets

CONTINUOUS HIGH INTENSITY DISPERSER WITH AGITATOR DISKS

FIELD OF THE INVENTION

A continuous mechanical disperser for dispersing fluid suspensions with solids contents of from about 20 to about 80 weight percent.

BACKGROUND OF THE INVENTION

U.S. Pat. No. 5,292,193 of James E. Funk discloses an apparatus for deagglomerating powder in a mixture of liquid and powder; although the apparatus of this patent is relative effective, it requires a substantial amount of power for a reasonable output per unit time and, additionally, a large tank, a large motor, and a relatively long processing time.

U.S. Pat. No. 5,409,313 of James E. Funk also discloses an apparatus for deagglomerating powder in a mixture of liquid and powder. Although the apparatus of this patent also is relatively effective, it also suffers from the same disadvantages as that of U.S. Pat. No. 5,292,193. The disclosure of each of these United States patents is hereby incorporated by reference into this specification.

It is an object of this invention to provide an apparatus for deagglomerating powder within fluid suspensions which produces the desired product in a substantially shorter period of time at lower power requirements than prior art devices;

It is another object of this invention to provide an apparatus for continuously deagglomerating powder in a fluid suspension;

It is another object of this invention to provide a relatively small apparatus for degglomerating powder in a fluid suspension;

SUMMARY OF THE INVENTION

In accordance with this invention, there is provided an apparatus for degglomerating powder in a mixture of liquid and powder. This apparatus is comprised of a tank with an inlet port and an outlet port, a rotating shaft, a first agitator and second agitator rotatably connected to such shaft, and a vortex suppressor disposed above the topmost of such agitators. Each of the agititators contains a multiplicity of teeth attached to its perimeter.

BRIEF DESCRIPTION OF THE DRAWINGS

The invention will be described by reference to the following drawings, in which like numerals refer to like elements, and in which.

DESCRIPTION OF THE PREFERRED EMBODIMENT

Figure 1:
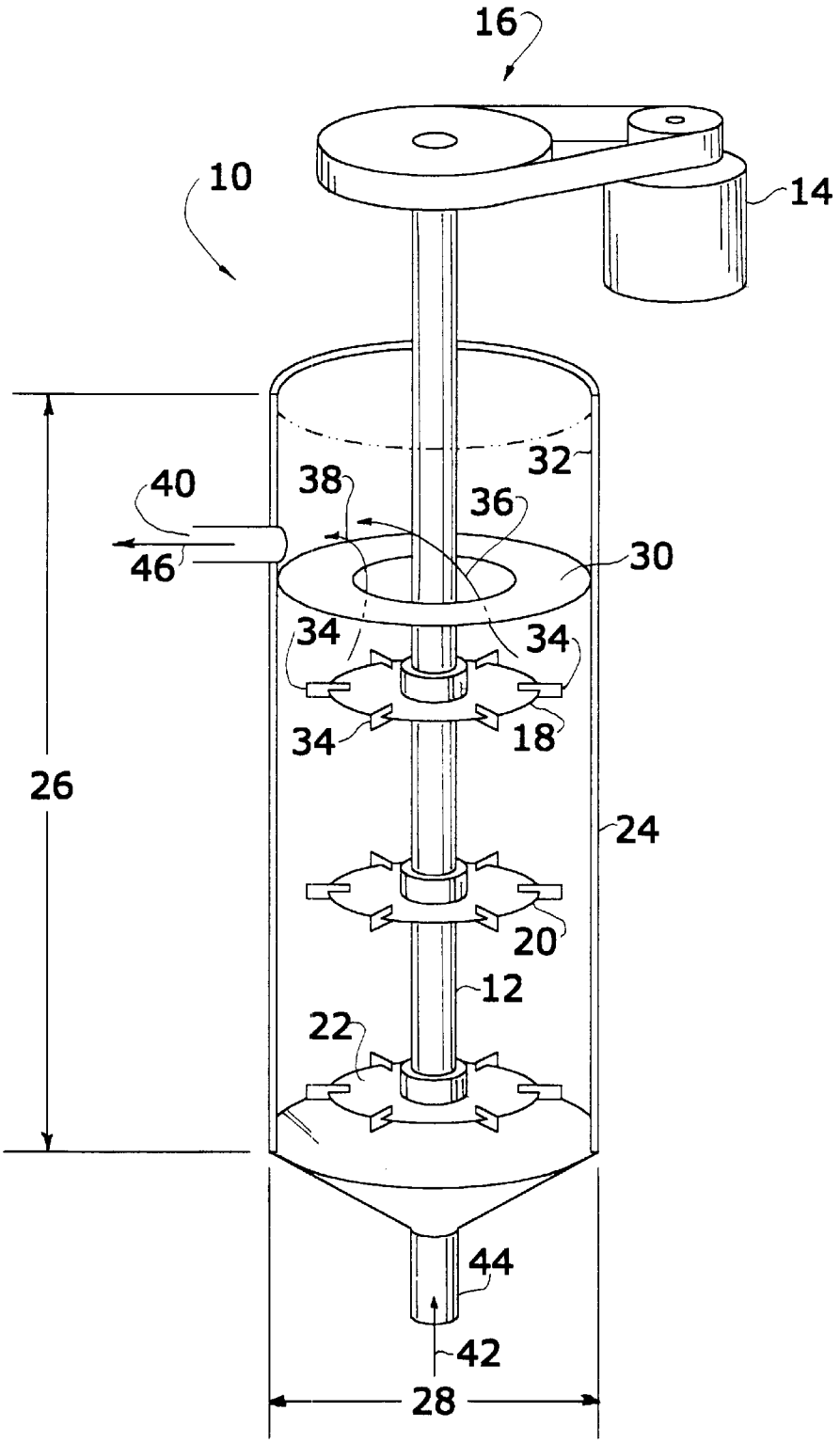
FIG. 1 is a schematic diagram of one preferred mixer of this invention.

FIG. 1 is a schematic view of a continuous high intensity disperser mixer 10 which is especially well adapted to mixing high solids content mixtures containing from about 20 to about 80 weight percent of solids. The mixer of this invention advantageously deagglomerates the fine powders in such mixtures and homogenizes any chemical additives present therein.

Referring to FIG. 1, it will be seen that the mixer 10 is comprised of a rotatable shaft 12 operatively connected to electric motor 14. In one embodiment, electric motor 14 is an alternating current electric motor with a horsepower rating of 50 which, with pulley system 16, turns shaft 12 (which, in the preferred embodiment depicted in FIG. 1, contains 12.0" diameter disks 18, 20, and 22) at a peripheral disk speed of 5,000 feet per minute. In another preferred embodiment, the peripheral disk speed is from about 4,500 to about 5,500 feet per minute.

Referring again to FIG. 1, it will be seen that shaft 12 is disposed within tank 24. Tank 24 may have a cross-section which is octagonal, or hexagonal, etc., but it preferably has a substantially circular cross section. However, substantially any cross-sectional shape may be used with this tank 24.

Tank 24 may be unlined or lined. When it is lined, it preferably is lined with stone, tile, rubber, and/or the like.

Tank 24 preferably has a height 26 which is from about 9 inches to about 20 feet, and a maximum cross-sectional dimension (which is the inside diameter in the case of a circular cross section) 28 from about 3 inches to about 3 feet. As will be apparent, the tank height 26 and the maximum cross-sectional dimension 28 will vary depending upon the size of the tank 24, the number of disks 18 et seq. disposed within it, the size of electric motor 14, etc. The ratio of the height 26 to the maximum cross sectional dimension 28 must be at least about 3/1 and, in one embodiment, is at least about 6/1.

In one embodiment, the tank height is 9 inches, and the inside diameter of the tank is 3 inches, for a ratio of 3/1. In another embodiment, the tank height is 18 inches, and the inside diameter of the tank is 6 inches, for the same ratio of 3/1. In yet another embodiment, the tank height is 108 inches, and the inside diameter is 36 inches. In yet another embodiment, the tank height is 216 inches, and the diameter is 36 inches, for a ratio of 6/1.

In general, the tank 26 height ranges from 9 inches to 216 inches (18 feet), and the tank inside diameter 28 ranges from 3 inches to 36 inches.

Referring again to FIG. 1, it will be seen that mixer 10 is comprised of a vortex suppressor 30. As will be apparent, the function of vortex suppressor 30 is to prevent or at least minimize the entrapment of air (not shown) through the vortex (not shown) surrounding the rotating shaft 12 so that air bubbles (not shown) do not form near the agitator tips 34 of rotating disk 18. Applicant has discovered that such entrapped air decreases the degree to which the rotating disk 18 deagglomerates and homogenizes the material within tank 24. The vortex suppressor 30 helps insure that the mixed material flows in the direction of arrows 36 and 38 and through port 40.

Referring again to FIG. 1, and to the preferred embodiment depicted therein, it will be seen that the material to be mixed is fed in the direction of arrow 42 vertically upward through port 44 and, after complete mixing and deagglomeration, exits in the direction of arrow 46 through port 40. As will be apparent, the feed rate used to feed the material will influence the residence time of the material within the mixer 10. In one embodiment, the preferred feed rate is from about 10 to about 50 liters per minute; such a feed rate was used with a material with a specific gravity of about 1.8 grams per cubic centimeter. In one embodiment, where the feed rate is 25 liters per minute, the residence time is about 60 seconds to obtain optimum deagglomeration and dispersion.

Figure 2:
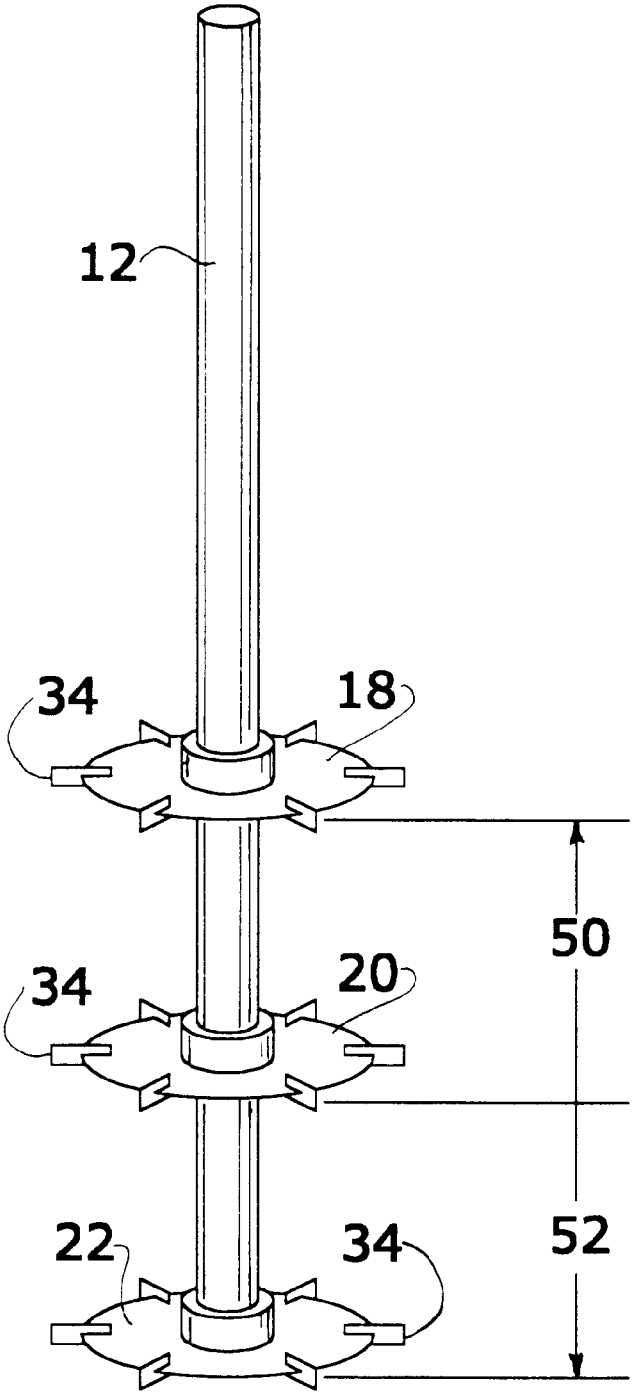
FIG. 2 is a schematic diagram of the rotatable shaft portion of the mixer of FIG. 1.

FIG. 2 is a partial schematic view of the mixer 10 of FIG. 1. In the embodiment depicted, it is important that the distance 50 between disk 18 and disk 20, the distance 52 between disk 20 and disk 22, is from about 50 to about 200 percent of the diameter of the disks 18, 20, and 22. In one embodiment, the diameters of disks 18, 20, and 22 are substantially equal. In another embodiment, the diameters of disks 18, 20, and 22 may be different; in this embodiment, the distance 50 is a function of the average diameter of adjacent disks 18 and 20.

The diameters of disks 18, 20, and 22 each preferably are from about 50 to about 70 percent of the inside diameter 28 of tank 24, and more preferably from about 55 to about 65 percent of such inside diameter 28.

In the embodiment depicted in FIG. 2, three rotatable agitator disks 18, 20, and 22, are depicted. In another embodiment, not shown, only two of such rotatable agitator disks are used. In general, from about 2 to about 10 such rotatable disks may be used, it being preferred to use from about 3 to about 5 such disks.

Figure 3:
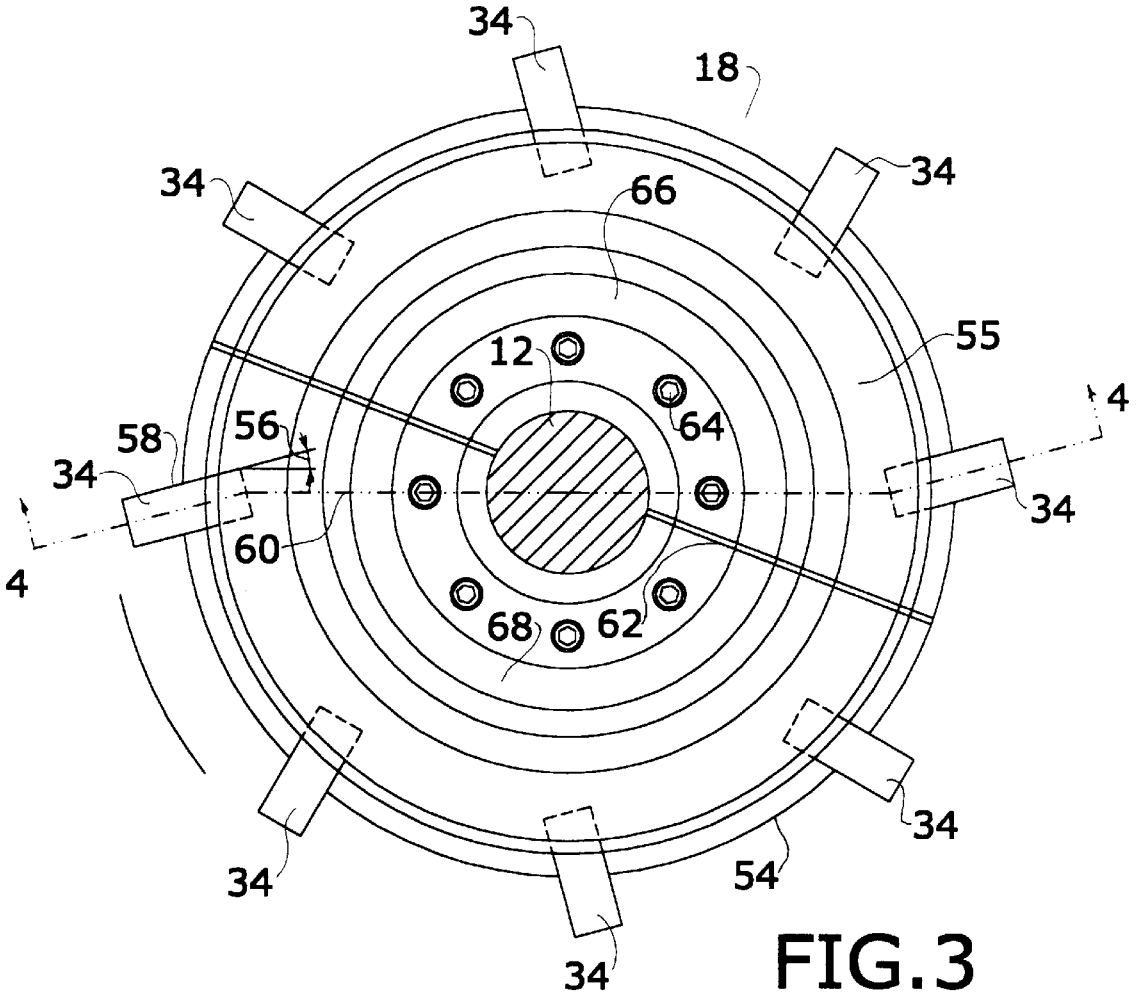
FIG. 3 is a top view of one preferred rotatable disk rotatably connected to the shaft of the mixer of FIG. 2.

FIG. 3 is a sectional view of one preferred embodiment of agitator disk 18; the other agitator disks used in the apparatus 10 preferably have a similar configuration.

The agitator disk depicted in FIG. 3 is similar to the agitator disks depicted in applicant's U.S. Pat. Nos. 5,292,193 and 5,409,313; the disclosure of each of these United States patents is hereby incorporated by reference into this specification. These latter agitator disks also may be used in applicant's claimed device.

Thus, by way of illustration, one may use in such device an agitator disk comprised of a multiplicity of compound teeth attached to the perimeter of said disk, wherein the distance between adjacent compound teeth on said perimeter of said agitator disk is from about 3 to about 5 inches (see claim 1 of U.S. Pat. No. 5,409,313). In this preferred embodiment, the agitator disk preferably has a thickness of from about 0.15 to about 0.5 inches, and the frontal area of said compound teeth attached to said agitator disk is from about 0.25 by 0.25 to about 1.0 inch by 1.0 inch; and each of said compound teeth is comprised of a substrate to which is attached a front plate, a top plate, and a bottom plate, wherein each of said front plate, said top plate, and said bottom plate consists essentially of ceramic material (see claim 1 of U.S. Pat. No. 5,292,193).

Referring again to FIG. 3, which depicts another preferred agitator disk 18, it will be seen that disk 18 is comprised of a multiplicity of teeth 34 disposed around the periphery 54 of disk 18.

Referring again to FIG. 3, and in the preferred embodiment depicted therein, it will be seen that each of teeth 34 is mounted so that it forms an angle 56 between the front face 58 of teeth 34 18 and the radius 60 of the disk 18 of from about 5 to about 45 degrees. In one preferred embodiment, angle 56 is from about 15 to about 30 degrees.

The frontal area of each of said teeth 34 is from about 0.02 square inches to about 1.5 square inches. In one embodiment, the frontal area of each of said teeth 34 is from about 0.02 inches to about 1 square inch The number of teeth 34 disposed on disk 18 is an even number, which ranges from about 4 to about 12 teeth, and preferably 4 to about 8 teeth.

In the preferred embodiment depicted in FIG. 3, agitator disk 18 is a two-piece disk cut through the center 62, preferably about halfway between adjacent teeth. As will be apparent, this embodiment affords one the advantage of readily assembling and disassembling disks 18 and 20 from shaft 12 by means of bolt holes 64 through which bolts (not shown) may be inserted to fasten each of halves 66 and 68 to a hub 70 (see FIG. 4).

Figure 4:
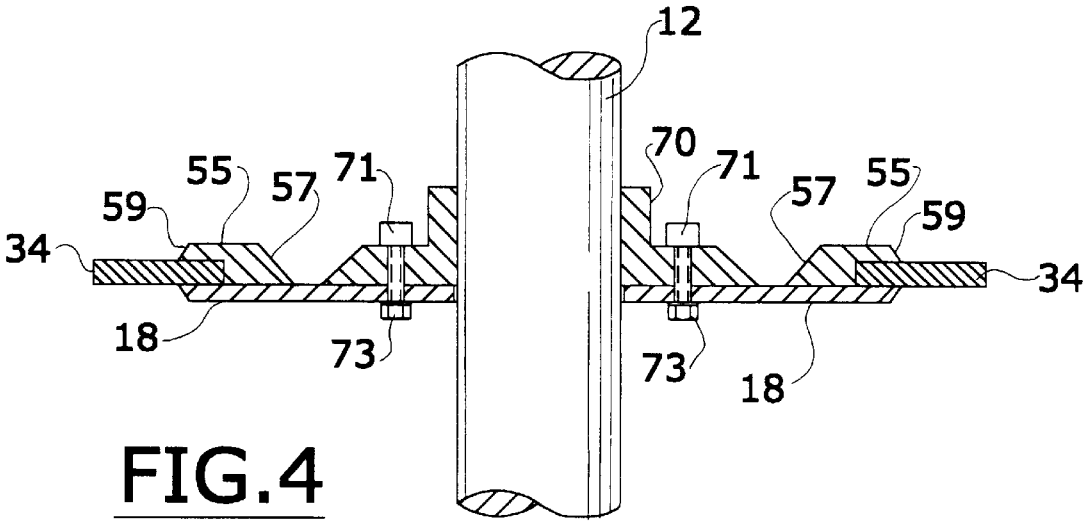
FIG. 4 is a sectional view taken through lines 4—4 of FIG. 3 of a portion of the shaft assembly of the apparatus of FIG. 1.

FIG. 4 is a partial schematic view of FIG. 3, taken through lines 4—4. Referring to FIG. 4, and in the preferred embodiment depicted therein, it will be seen that teeth 34 are attached to disk 18 by means of an annular ring 55 which may attached to disk 18 by conventional means, such as nuts and bolts.

In the embodiment depicted, it will be seen that annular ring 55 preferably has an inner chamfer 57 and an outer chamfer 59, each of which preferably is at least about 45 degrees and most preferably is from about 45 to about 60 degrees, preferably oriented as shown in FIG. 4. Furthermore, in this preferred embodiment, bolts 71 and nuts 73 secure the agitator disk 18 to hub 70.

The agitator teeth 34 may consist essentially of hard faced steel, hardened steel, ceramic material such as metal carbides, aluminum oxide, and the like. These agitator teeth may be affixed between annular ring 55 and disk 18 and attached thereto by conventional means such as, e.g., clamp means, brazing the teeth to the agitator disk 18, silver solder, high density epoxy, other adhesive materials, and the like.

Figure 5:
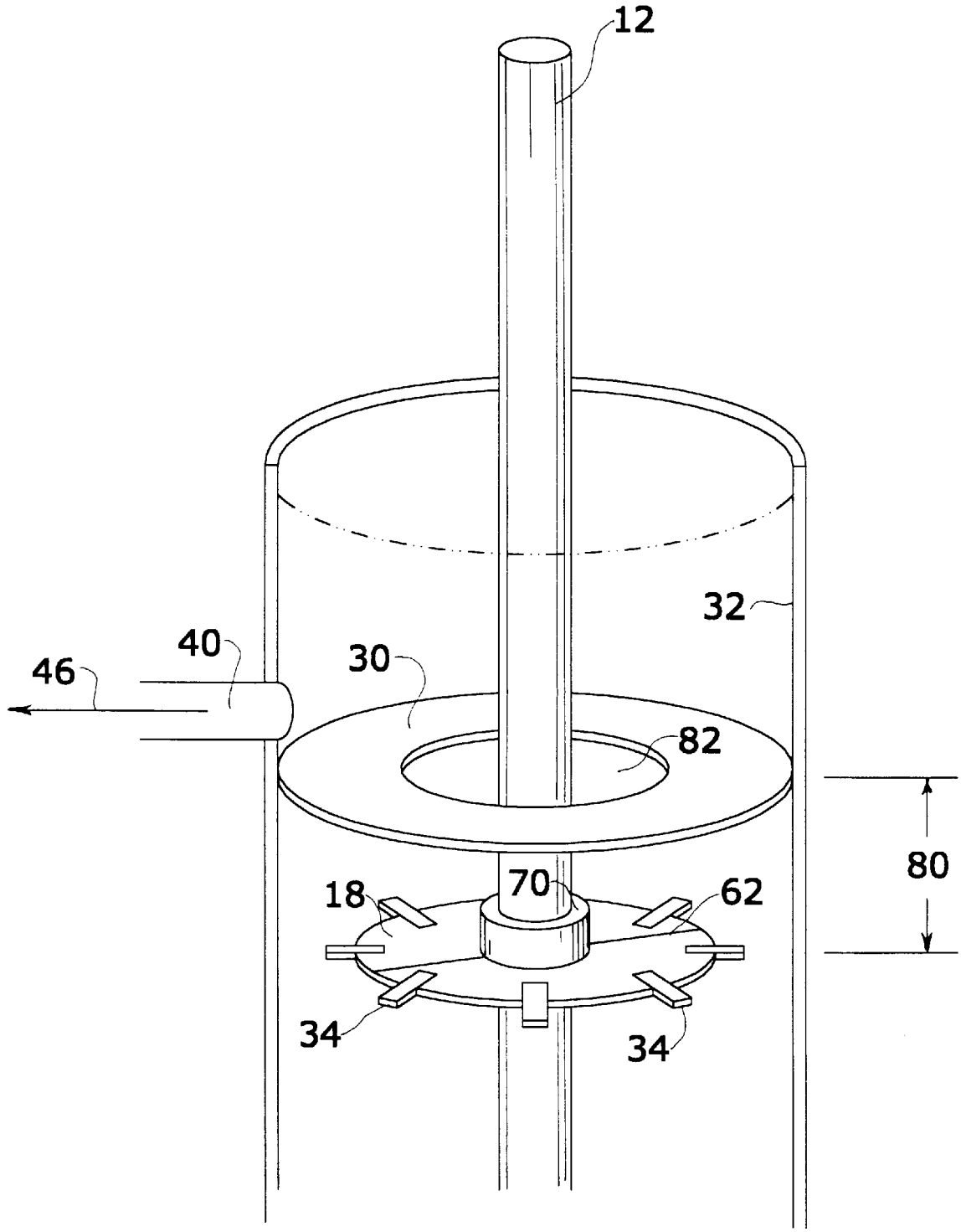
FIG. 5 is partial schematic view of one preferred mixing apparatus of the invention.

In the embodiment depicted in FIG. 5, which is a partial schematic view of the mixer of FIG. 1, a vortex suppressor 30 is connected to the inside surface 32 of tank 24. The distance 80 between the vortex suppressor 30 and the disk 18 is from about 30 to about 60 percent of the inside diameter 28 (see FIG. 1) of tank 24.

In the embodiment of FIG. 5, an orifice 82 is preferably centrally disposed within vortex suppressor 30 and approximately centrally disposed about shaft 12 and has a diameter of from about 2 to about 3 times the diameter of shaft 12.

Figure 6:
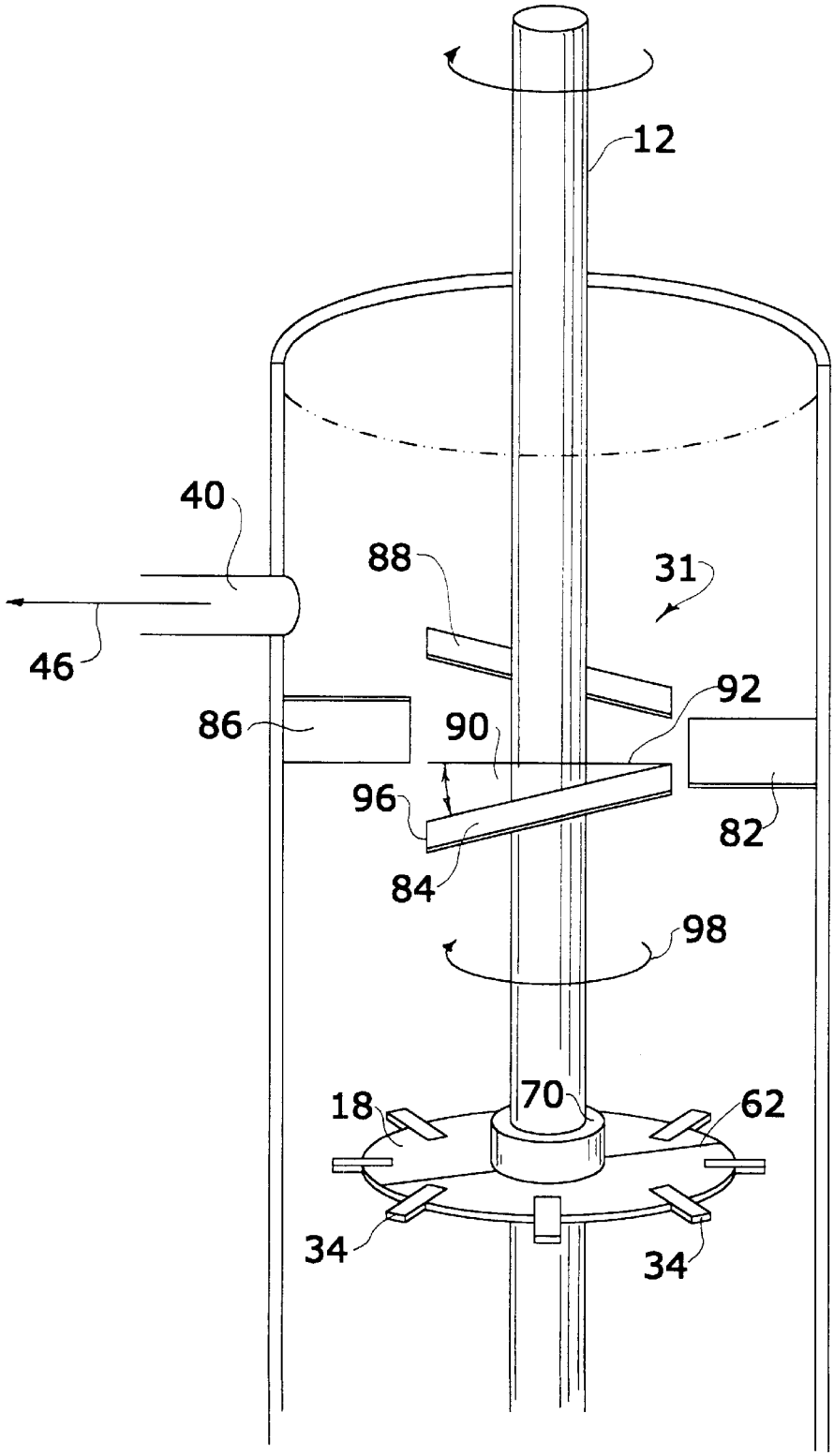
FIG. 6 is a partial schematic view of another preferred mixing apparatus of the invention.

The embodiment depicted in FIG. 6 uses a different vortex suppressor 31, which is similar to the baffles described in U.S. Pat. No. 5,292,193. This vortex suppressor is comprised of at least about 4 baffles (such as baffles 82, 84, 86, and 88). In general, from about 2 to about 8 such baffles may be used, depending upon the inner diameter 28 of the tank 12.

These baffles may be connected to the inner wall of tank 28 (see, e.g., U.S. Pat. No. 5,292,193), or to a cover (not shown) for tank 24, if desired. They preferably form an angle 90 with the horizontal plane 92 of from about 10 to about 40 degrees, and more preferably from about 20 to about 30 degrees. Without wishing to be bound to any particular theory, applicant believes that the lowest point 96 on baffle 84, e.g., is always downstream in the rotational flow of material being mixed within mixer 10; in the embodiment depicted in FIG. 6, the rotational flow is in the direction of arrow 98, and baffle 84 is so inclined. Although this feature has been illustrated with respect only to baffle 84, it will be understood that all of the other baffles are similarly disposed and mounted.

It has been discovered that the apparatus described herein not only is effective for the stated deagglomeration of powders, but also effectively homogenizes additive chemicals and/or other ingredients.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. An apparatus for deagglomerating powder in a mixture of liquid and powder, wherein said apparatus is comprised of a mixing tank, a first agitator disk disposed within said mixing tank wherein said first agitator disk rotates in a horizontal plane, a second agitator disk disposed within said mixing tank wherein said second agitator disk rotates in a horizontal plane and is disposed above said first agitator disk, a rotatable shaft connected to each of said first agitator disk and said second agitator disk, and a vortex suppressor disposed above said second agitator disk, wherein:

(a) said mixing tank has a height which is from about 9 inches to about 20 feet, and an inside diameter of from about 3 inches to about 3 feet, wherein the ratio of said height to said inside diameter is at least about 3/1;

(b) the distance between said first agitator disk and said second agitator disk is from about 50 to about 200 percent of the diameter of said first agitator disk, (c) each of said first agitator disk and said second agitator disk is comprised of from about 4 to about 12 teeth attached around the periphery of each of said first agitator disk and said second agitator disk, wherein:

1. the frontal area of each of said teeth is from about 0.02 to about 1.5 square inches,
2. each of said teeth is so attached that it forms an angle between the front face of each of said teeth and the radius of said disk of from about 5 to about 45 degrees, (d) each of said first agitator disk and said second agitator disk is comprised of a first half and a second half, each of which is attached to a hub connected to said rotatable shaft, and (e) said vortex suppressor is disposed above said second agitator disk at a distance which is from about 30 to about 60 percent of said inside diameter of said mixing tank.

2. The apparatus as recited in claim 1, wherein each of said first agitator disk and said second agitator disk has a substantially circular cross-sectional shape with a diameter of about 12 inches.

3. The apparatus as recited in claim 1, wherein said mixing tank has a substantially circular cross-sectional shape.

4. The apparatus as recited in claim 1, wherein the ratio of said height to said inside diameter is 3/1.

5. The apparatus as recited in claim 1, wherein the ratio of said height to said inside diameter is 6/1.

6. The apparatus as recited in claim 1, wherein said mixing tank has a height of from about 9 inches to about 216 inches.

7. The apparatus as recited in claim 1, wherein said apparatus is further comprised of a third agitator disk which rotates in a horizontal plane and is disposed below said first agitator disk.

8. The apparatus as recited in claim 7, wherein each of said first agitator disk, said second agitator disk, and said third agitator disk have substantially circular cross-sectional shapes with diameters which are substantially equal to each other.

9. The apparatus as recited in claim 8, wherein the diameter of each of said first agitator disk, said second agitator disk, and said third agitator disk is from about 50 to about 70 percent of said inside diameter of said mixing tank.

10. The apparatus as recited in claim 1, wherein said apparatus is comprised of from about 2 to about 10 agitator disks.

11. The apparatus as recited in claim 1, wherein said frontal area of each of said teeth is from about 0.02 to about 1.0 square inches.

12. The apparatus as recited in claim 1, wherein said teeth are attached to each of said-agitator disks by means of annular ring.

13. The apparatus as recited in claim 12, wherein said annular ring is connected to one of said agitator disks.

14. The apparatus as recited in claim 1, wherein an orifice is preferably centrally disposed within said vortex suppressor.

15. The apparatus as recited in claim 14, wherein said orifice has a substantially circular cross-sectional shape with a diameter which is from about 2 to about 3 times the diameter of said rotatable shaft.

* * * * *